United States Patent [19]

Baker et al.

[11] 4,085,910

[45] Apr. 25, 1978

[54] DUAL MODE OPTICAL SEEKER FOR GUIDED MISSILE CONTROL

[75] Inventors: William G. Baker, Rolling Hills Estates; James H. Gisbrecht, Rolling Hills; Edward T. Luszcz, Anaheim, all of Calif.

[73] Assignee: Northrop Corporation, Los Angeles, Calif.

[21] Appl. No.: 243,280

[22] Filed: Apr. 12, 1972

[51] Int. Cl.[2] ..... F41G 7/00; F42B 15/02; G06F 15/50

[52] U.S. Cl. ..... 244/3.16; 356/149; 350/16

[58] Field of Search ..... 244/3.16; 356/149, 248; 350/16; 250/83.3 H; 178/DIG. 20, DIG. 21

[56] References Cited

U.S. PATENT DOCUMENTS 2,995,318 8/1961 Cocharo ..... 244/3.16

3,514,179 5/1970 Koeber ..... 356/149

*Primary Examiner*—Maynard R. Wilbur
*Assistant Examiner*—T. M. Blum
*Attorney, Agent, or Firm*—Edward A. Sokolski

[57] ABSTRACT

An optical assembly is mounted in the nose of a missile, this assembly including an infra-red sensor for sensing the orientation of the missile relative to an infra-red illuminated target, and a visible sensor such as a vidicon for determining the orientation of the missile relative to a visible target. The infra-red and visible detectors may be used alternatively for acquiring and tracking a target, as the situation may demand. The optical unit is stabilized in space about the pitch and yaw axes thereof by means of a gyro stabilized platform unit which is separated therefrom and linked thereto by coupling rods which cause the optical assembly to accurately follow the stabilized platform in both yaw and elevation.

8 Claims, 10 Drawing Figures

DUAL MODE OPTICAL SEEKER FOR GUIDED MISSILE CONTROL

This invention is related to optical seekers for guided missile control, and more particularly to such a seeker having dual infra-red and visible modes of operation.

In the guidance of missiles and other vehicles to a predesired target or destination, the target is usually acquired and tracked by providing means on the missile for detecting electromagnetic energy from the target. This energy may be in the radio frequency range, or may be in the light energy spectrum. Systems have been developed in the prior art for utilizing combinations of energy radiation in the seeker to maximize advantages afforded by one form of energy or the other. The sensor and seeker units of these systems, however, have generally lacked the compactness and simplicity of construction to be desired, particularly for use in smaller, less expensive missiles.

In implementing a seeker system, it is generally necessary that the seeker unit be inertially stabilized so that it will not lose the target should the aiming of the missile be diverted. This end result is usually achieved by mounting the optics on the stable platform itself, along with its gimbaling, torquers, pickoffs, etc. This greatly increases the bulk of the hardware surrounding the seeker unit. As this unit must be mounted right in the nose of the missile for optimum effectiveness, the presence of this additional hardware makes it difficult to design the configuration of the missile nose for optimum aerodynamic characteristics. Further, the combination of the optical hardware with the platform hardware somewhat complicates and increases the cost of repair and maintenance in that the combined units must be removed for repair or replacement in situations where only one may be at fault and require such action.

The device of this invention overcomes the aforementioned shortcomings of the prior art devices in providing a dual mode (infra-red and visible) seeker in which the optical unit is separate and apart from the stabilization unit and is linked thereto by a simple rod connector assembly. The optical seeker of this invention is of simple and economical construction which lends itself to mounting in the nose of the missile without detracting from the aerodynamic characteristics of such missile. In view of its separation from the platform hardware, the optical seeker assembly can be readily removed as a separate unit for service and repair. Further, the device of this invention provides an alternative capability for using either infra-red or visible light energy in acquiring and tracking targets, so that the optimum advantages of each can be selectively utilized as a particular situation may require.

It is therefore an object of this invention to provide an improved dual mode optical seeker of simple and economical construction.

It is a further object of this invention to provide a dual mode optical seeker which lends itself to mounting in the nose of a missile without hampering the aerodynamic characteristics of such missile.

It is another object of this invention to provide a dual mode optical seeker which is easier to service and replace than certain prior art devices.

Other objects of this invention will become apparent as the description proceeds in connection with the accompanying drawings, of which:

Briefly described, the device of the invention is as follows: An optical unit which includes both infra-red and visible sensors which may comprise an I-R quadrant detector and a vidicon respectively, is mounted in the nose of a missile for positioning relative to the missile frame in both azimuth and elevation. The optical assembly includes means for directing infra-red energy only to the infra-red detector and all of the light energy to the visible detector. The optical assembly is connected to a gyro stabilized platform by means of rod members such that the optical assembly follows the stabilized platform in azimuth and elevation and thus is maintained stabilized relative to the missile housing.

Figure 1:
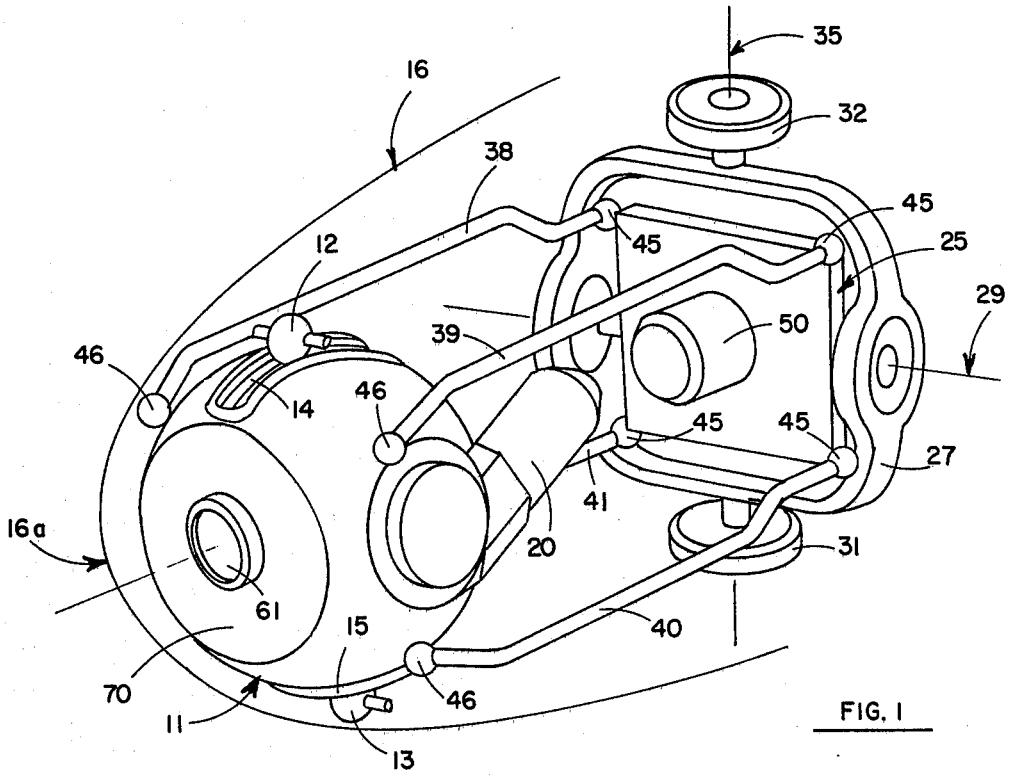
FIG. 1 is a schematic drawing illustrating a preferred embodiment of the invention.

Referring now to FIG. 1, the basic structure of the device of the invention is schematically illustrated. Optical assembly 11 is supported in the missile casing on pivot ball supports 12 and 13 for movement in elevation along races 14 and 15 formed in the housing of assembly 11, and for movement in azimuth pivotally on ball members 12 and 13. Optical assembly 11 is included in the nose of missile 16 with window 16a being provided in the nose for passing light energy therethrough. Optical assembly 11 includes a vidicon 20 and an infra-red detector 22 (see FIG. 2).

An inertially stabilized platform 25 is supported in gimbal 27 for rotation about a pitch axis 29, gimbal 27 in turn being supported in bearings 31 and 32 attached to the missile housing for rotation about a yaw axis 35. Optical assembly 11 is connected to stabilized platform 25 by means of rods 38-41, each of the rods being connected to a separate corner of the stabilized platform. Rods 38–41 are connected to platform 25 by means of ball and socket joints 45 and to optical assembly 11 by means of ball and socket joints 46. Platform 25 includes a stabilizing gyro 50 and pickoff and torquer devices which operate in response to a stabilizing servo system in a manner well known in the art. Thus, by virtue of the linkage provided between stable platform 25 and optical assembly 11 by means of rods 38–41, the optical assembly follows the stable platform and thus is maintained stabilized in space about the yaw and pitch axes 35 and 29 respectively.

Figure 2:
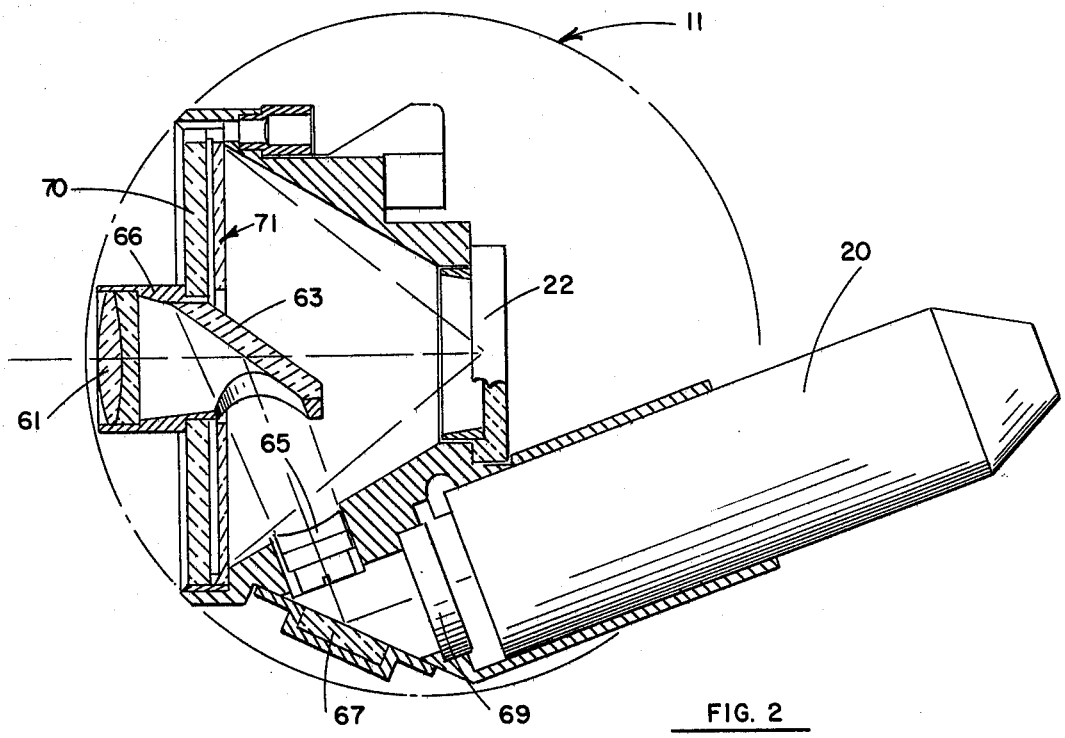
FIG. 2 is an elevational view illustrating the optical assembly unit of the preferred embodiment.
Figure 3:
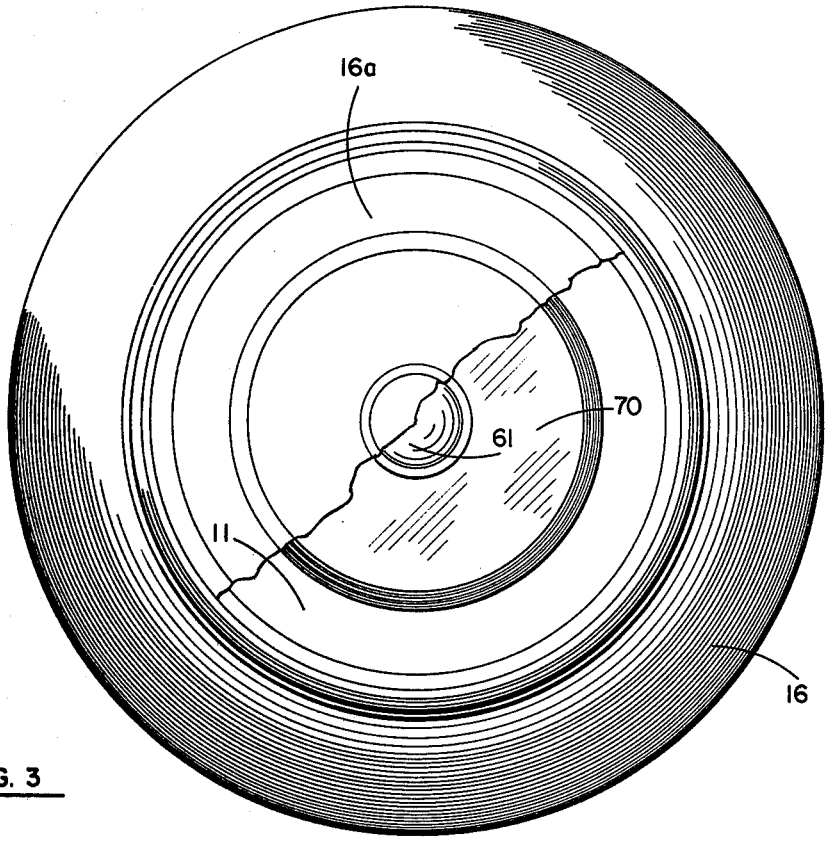
FIG. 3 is a front elevational view of the preferred embodiment.

Referring now to FIG. 2, the optical components of assembly 11 are illustrated. Light energy passes through objective doublet lens assembly 61 into mirror 63 from where it passes through a telephoto doublet lens 65 into mirror 67. The visible energy thus acquired then passes through a light filter 69 to the input of vidicon 20. Thus, vidicon 20 receives a visible input which may typically comprise a field of view 4° square.

Infra-red filter 70 forms an apertured disc surrounding the assembly 66 supporting lens 61. This filter operates to pass light only within the infra-red spectrum. The infra-red light energy passing through filter 70 and Fresnel lens 71 is received by infra-red detector 22 which may comprise a quadrant detector, which indicates deviations of the bore axis of the optical assembly from an infra-red beam in both azimuth and elevation. Typically, in the operation of the infra-red detection of this system, a target is acquired and tracked by radiating a laser beam of infra-red energy from a control source onto the target of interest, the energy reflected from the target being received by the infra-red detector.

Figure 7:
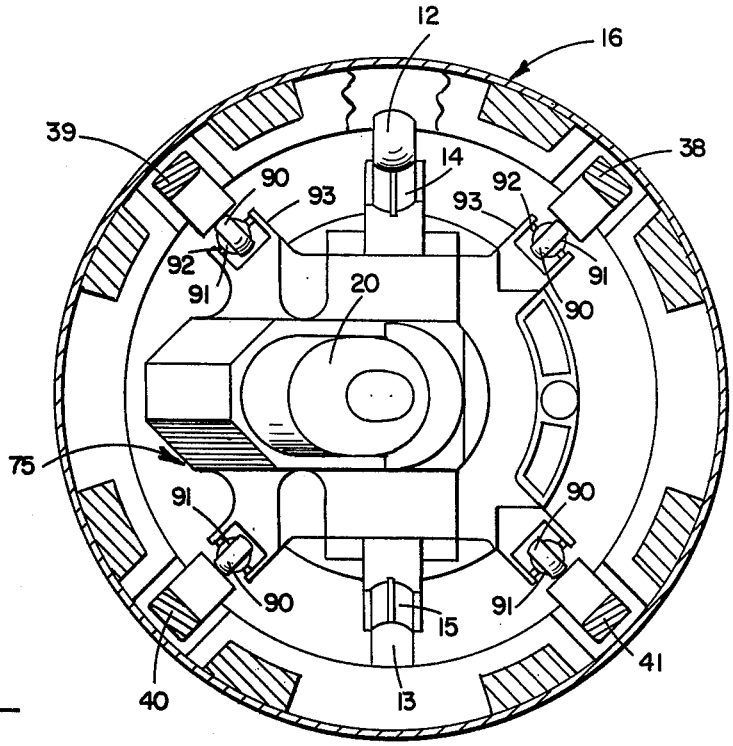
FIG. 7 is a cross-sectional view taken along the plane indicated by 7—7 in FIG. 5.
Figure 6:
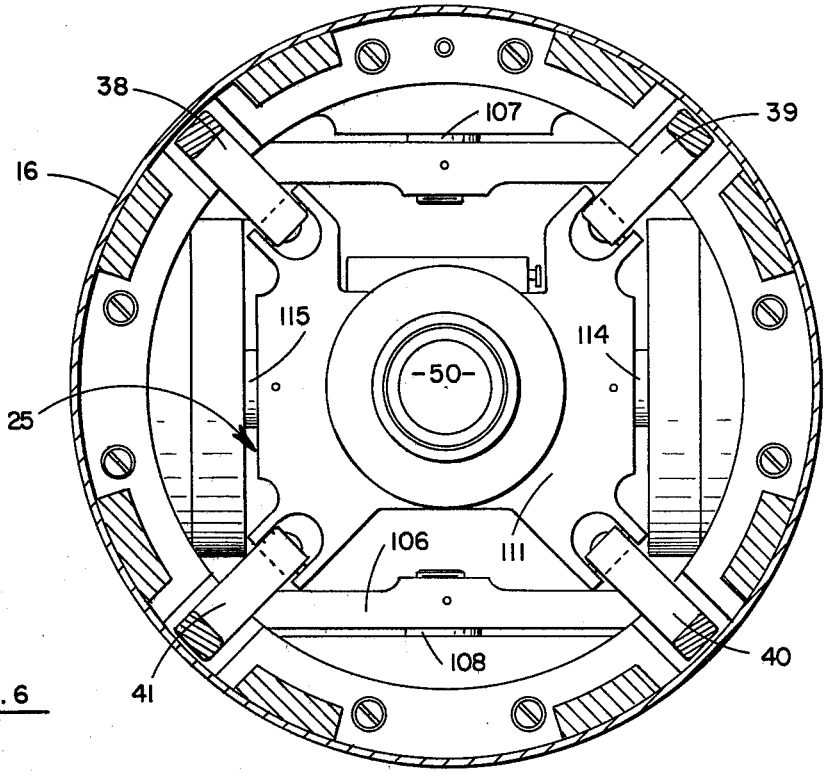
FIG. 6 is a cross-sectional view taken along the plane indicated by 6—6 in FIG. 5.
Figure 4:
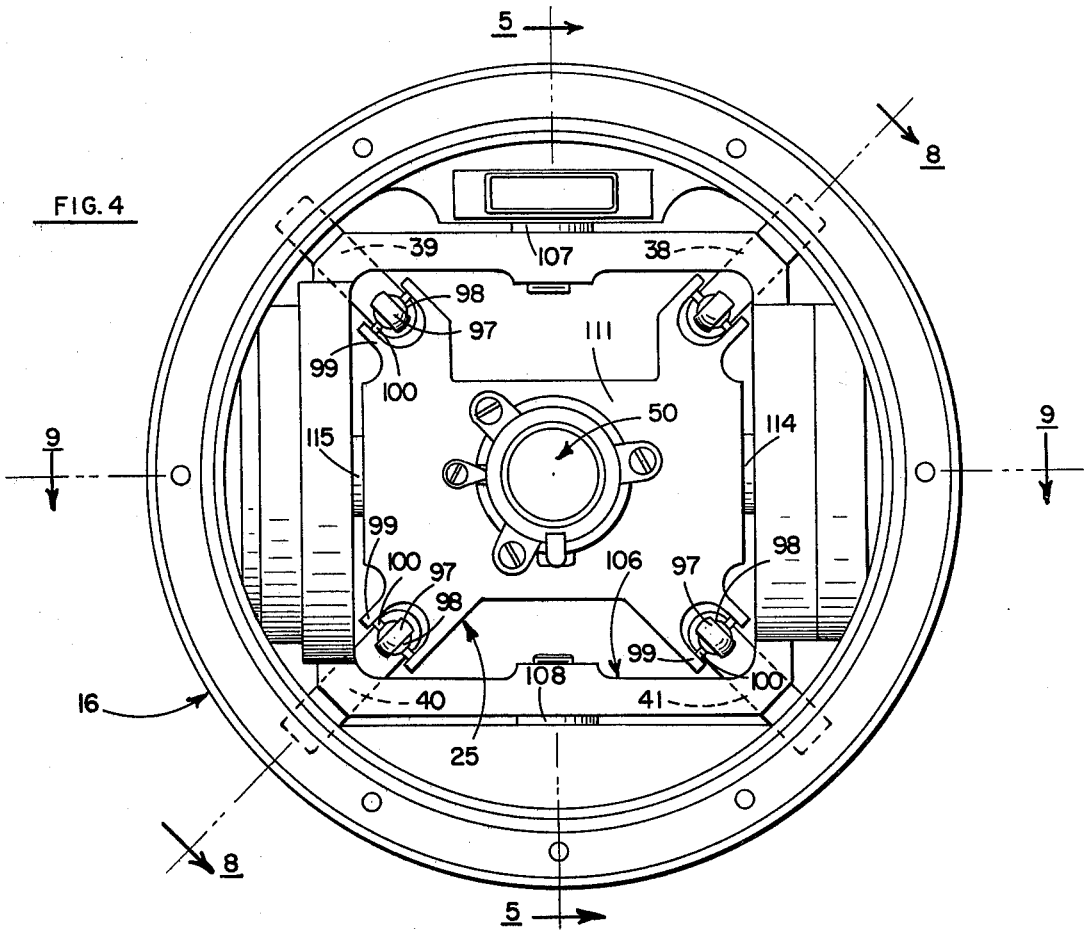
FIG. 4 is a rear elevational view of the preferred embodiment.
Figure 5:
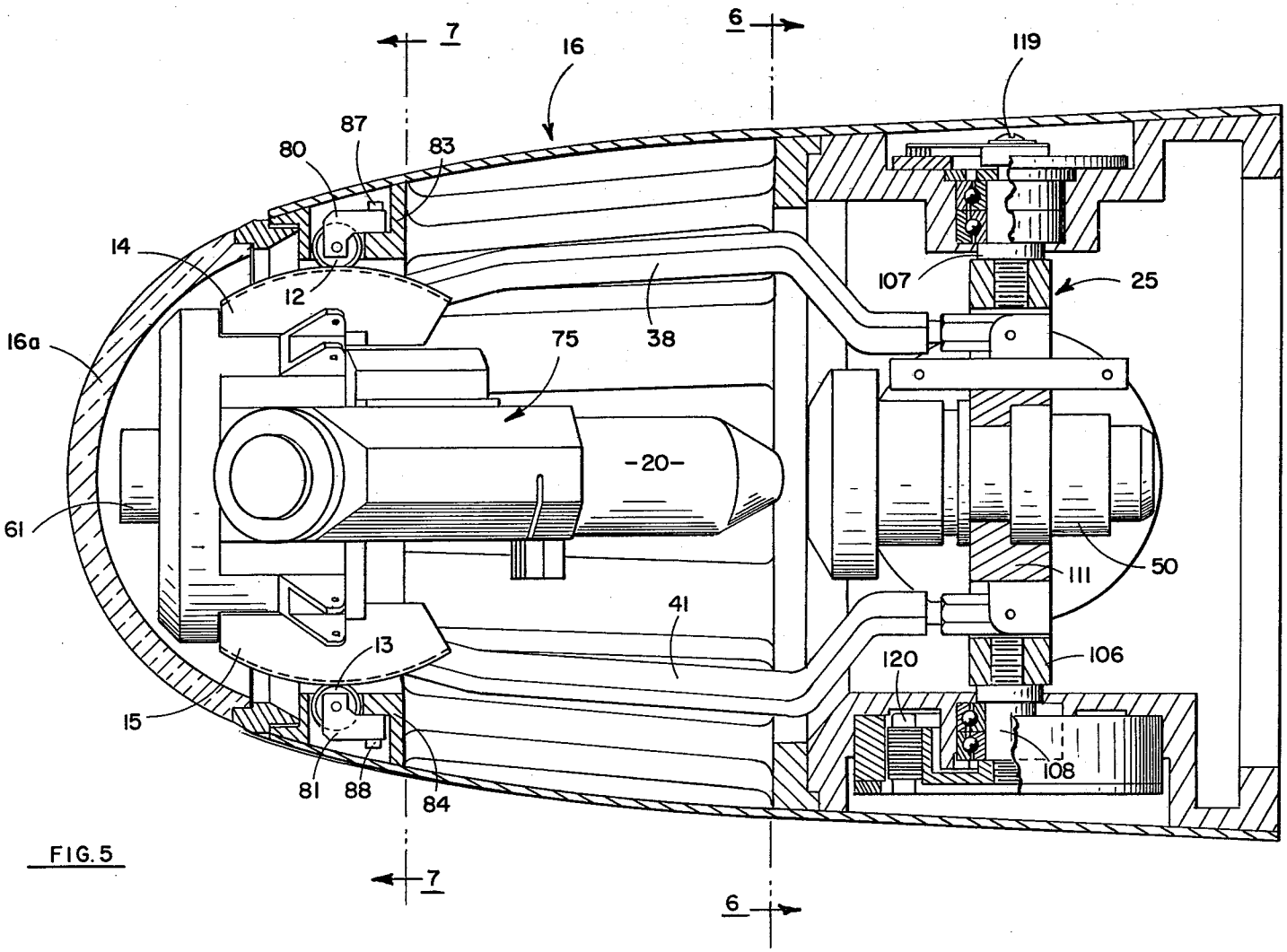
FIG. 5 is a cross-sectional view taken along the plane indicated by 5—5 in FIG. 4.
Figure 8:
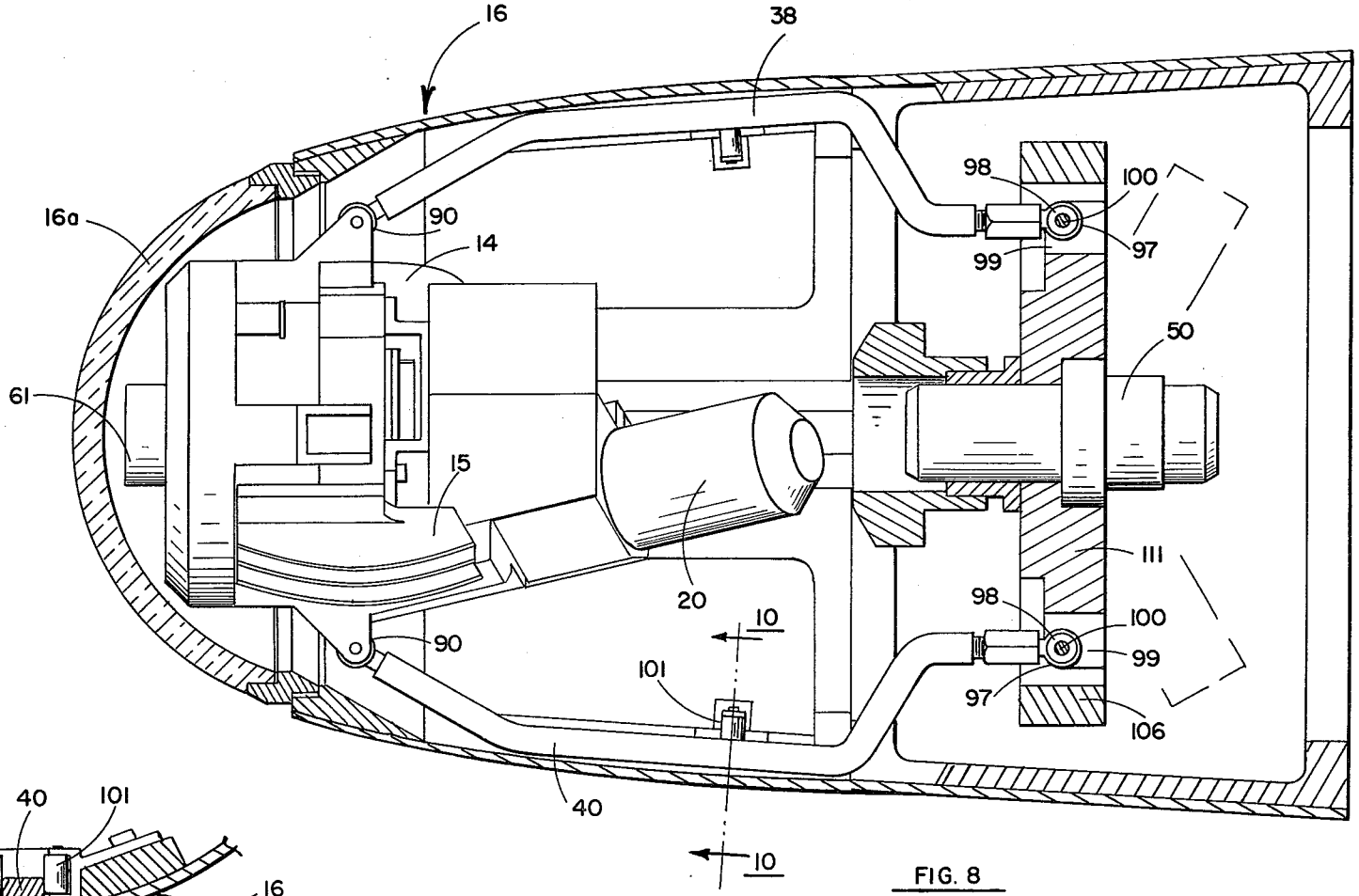
FIG. 8 is a cross-sectional view taken along the plane indicated by 8—8 in FIG. 4.
Figure 9:
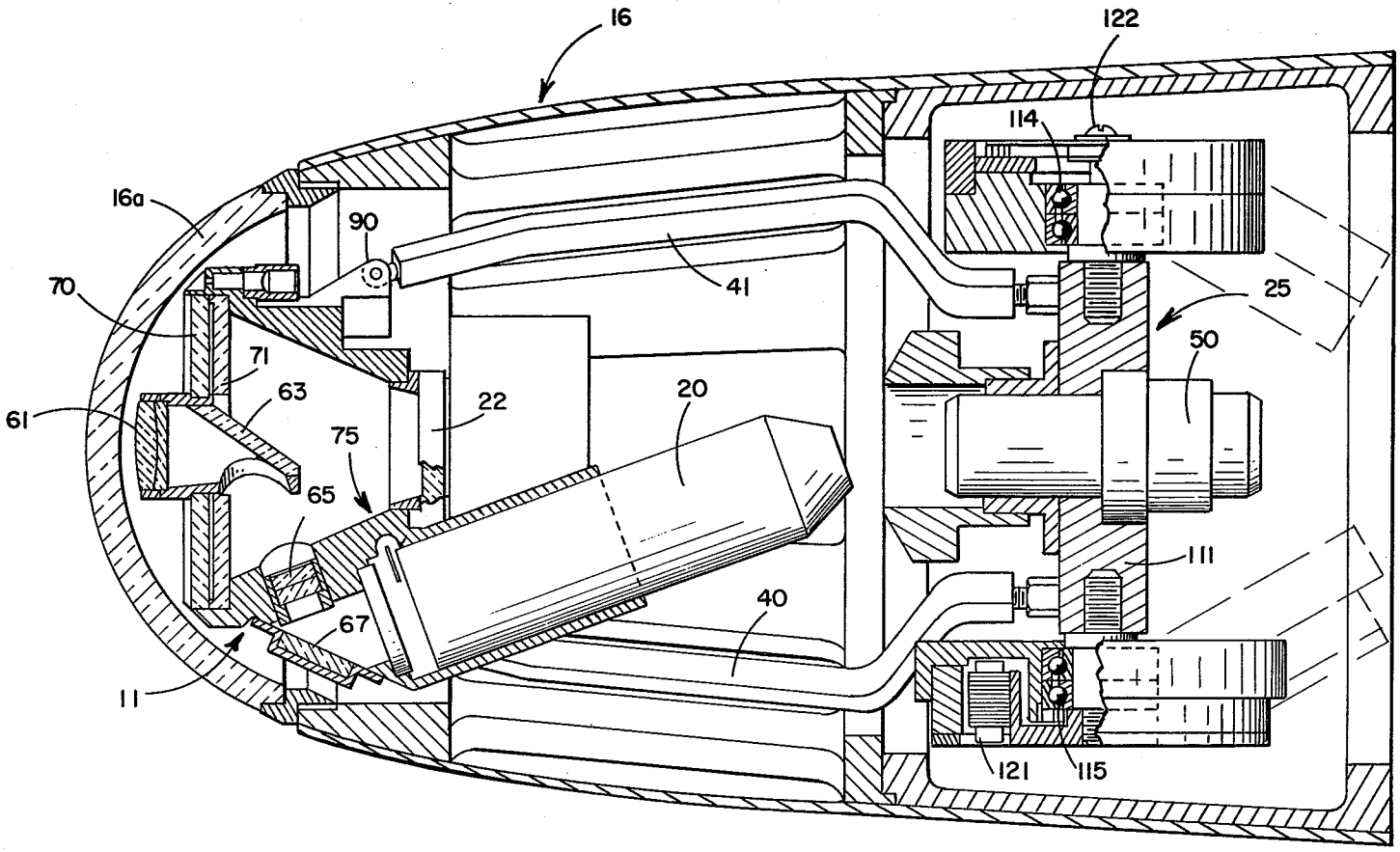
FIG. 9 is a cross-sectional view taken along the plane indicated by 9—9 in FIG. 4.

Referring now to FIGS. 3–10, a preferred embodiment of the invention is illustrated. With reference particularly to FIGS. 5, 7 and 9, the optical assembly includes a support frame 75 on which vidicon 20 is mounted. Also mounted on optical assembly support frame 75 are the optics for bringing visual signals to the vidicon which includes lenses 61 and 65, and mirrors 63 and 67. The optical assembly also includes infra-red detector 22 which may comprise a quadrant detector, lens 71 and filter 70 which passes only the infra-red energy. Optical assembly 11 is supported in the casing 16 of the missile on a pair of pivot wheels 12 and 13 which ride in arcuate raceways 14 and 15 respectively, which are attached to the upper and lower portions of the frame of the optical assembly. Pivot wheels 12 and 13 are supported on brackets 80 and 81 respectively. Brackets 80 and 81 are mounted on arms 83 and 84 respectively by means of associated screws 87 and 88. Arms 83 and 84 are attached to the missile casing 16. The optical assembly is thus supported in the missile case for movement about mutually orthogonal axes which correspond to the pitch and yaw axes of the systems, by rolling within balls 12 and 13 for pitch movement and pivoting about balls 12 and 13 for yaw movement.

Connected to the casing 75 of the optical assembly at equally spaced points around the periphery thereof are rods 38-41. As best can be seen in FIG. 7, these rods are pivotally connected to housing 75 of the optical assembly by means of sleeves 90 which wrap around and are pivotally supported on ball members 91. Ball members 91 are supported on pins 92 which are mounted in U-shaped portions 93 of the optical assembly frame. Thus, a pivotal sleeve bearing is formed between sleeves 90 and balls 91.

As best can be seen in FIG. 4, the opposite ends of rods 38–41 are similarly connected to platform 25 with sleeve portions 97 slidably supported on ball members 98 which are supported in U-shaped portions 99 of the platform by means of pins 100. It thus should be apparent that optical assembly 11 will follow the motion of the platform in both azimuth and elevation by virtue of the coupling afforded between these two units by means of rods 38–41.

Figure 10:
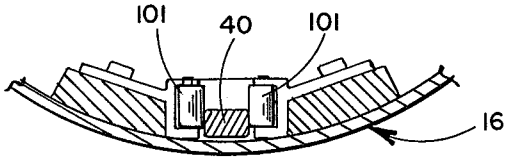
FIG. 10 is a cross-sectional view taken along the plane indicated by 10—10 in FIG. 10.

Referring to FIGS. 8 and 10, the rods 38–41 are positioned and guided by means of roller guides 101 which are rotatably supported on missile casing 16 and which form U-shaped slots for receiving the rods.

Referring now particularly to FIGS. 4, 5, 6 and 9, we will now examine the platform assembly 25. Platform assembly 25 has an outer gimbal 106 as can best be seen in FIG. 4, which is mounted for rotation in azimuth on casing 16 by means of ball bearings 107 and 108. The central platform portion 11 is supported on gimbal 106 for rotation in elevation by means of ball bearings 114 and 115. Mounted on central platform portion 111 is two-axis gyroscope 50 which operates in conjunction with pickoff potentiometer 119 and torque motor 120 for the azimuth axis and pickoff potentiometer 122 and torquer motor 121 for the elevation axis, to maintain the platform inertially stabilized.

The device of the invention thus provides a dual mode seeker utilizing a dual optical assembly for visual and infra-red acquisition and tracking, this unit being slaved to a stabilized platform by means of interconnecting rods, but otherwise being independent of this platform.

While the device of the invention has been described and illustrated in detail, it is to be clearly understood that this is by way of example and illustration only and is not to be taken by way of limitation, the spirit and scope of this invention being limited only by the terms of the following claims.

We claim:

1. In a dual mode optical seeker having an optical assembly comprising optical units for separately sensing visible signals and infra-red signals, said optical assembly being mounted for pivotal motion about azimuth and elevation axes, the improvement comprising means for inertially stabilizing said optical assembly without mounting said assembly on a stable platform, said improvement including:

a stable platform unit, means for inertially stabilizing said platform unit, and rod means for interconnecting said platform unit with said optical assembly to cause said optical assembly to precisely physically follow said platform unit in azimuth and elevation.

2. The device of claim 1 wherein said rod means comprises a plurality of rods spaced around said platform unit and pivotally connected thereto at one end thereof, said rods being pivotally connected to said optical assembly at the opposite ends thereof.

3. The device of claim 2 wherein said platform unit has a rectangular configuration, there being four rods, said one end of each of said rods being connected to one of the corners of said platform unit, the opposite ends of said rods each being connected to a separate portion of the optical assembly, said last mentioned optical assembly portions being symmetrically arranged about the periphery of said assembly.

4. The device of claim 1 wherein said optical assembly includes a centrally located infra-red detector, a vidicon, an infra-red optical filter in the form of a disc having an aperture at the center thereof, said infra-red detector being positioned to receive the light output from said infra-red filter, and a lens system internally concentric with said infra-red filter for directing visible light to the input of said vidicon.

5. A dual mode seeker for a missile having visible and infra-red sensing systems comprising:

an optical assembly for supporting said sensing systems, means for pivotally supporting said optical assembly in the nose of said missile for rotation about pitch and yaw axes, a gyro stabilized platform, means for pivotally supporting said platform in said missile for rotation about mutually orthogonal axes defining yaw and pitch axes, and rod means interconnecting said optical assembly and said platform to cause said optical assembly to follow said platform in yaw and pitch.

6. The device of claim 5 wherein said rod means comprises a plurality of rods pivotally connected at one end thereof to said platform and at the opposite end thereof to said optical assembly.

7. The device of claim 6 wherein the number of said rods is four, said platform being rectangular in configuration, each of said rods being connected to a separate corner of said platform.

8. The device of claim 5 wherein said means for pivotally supporting said optical assembly comprises a pair of arcuate tracks on opposite sides of said optical assembly and ball means for each of said tracks mounted in said missile, said ball means each riding in an associated one of said tracks.

* * * * *